US007918171B2

(12) United States Patent
Miyoshi

(10) Patent No.: US 7,918,171 B2
(45) Date of Patent: Apr. 5, 2011

(54) THREADING DEVICE OF SEWING MACHINE

(75) Inventor: Takanao Miyoshi, Tokyo (JP)

(73) Assignee: Juki Corporation, Chofu-shi, Tokyo (JP)

( * ) Notice: Subject to any disclaimer, the term of this patent is extended or adjusted under 35 U.S.C. 154(b) by 375 days.

(21) Appl. No.: 12/208,505

(22) Filed: Sep. 11, 2008

(65) Prior Publication Data

US 2009/0064914 A1 Mar. 12, 2009

(30) Foreign Application Priority Data

Sep. 12, 2007 (JP) ..... 2007-236739

(51) Int. Cl.
*D05B 87/02* (2006.01)
*D05B 61/00* (2006.01)
*D05B 1/08* (2006.01)

(52) U.S. Cl. ..... 112/225; 112/187; 112/163; 112/197

(58) Field of Classification Search ..... 112/163, 112/165, 187, 197–202, 274, 275, 225
See application file for complete search history.

(56) References Cited

U.S. PATENT DOCUMENTS

| | | | | | |
|---|---|---|---|---|---|
| 5,383,414 | A * | 1/1995 | Winter et al. | ..... | 112/162 |
| 5,653,187 | A * | 8/1997 | Kawamoto et al. | ..... | 112/320 |
| 5,901,655 | A * | 5/1999 | Sadasue | ..... | 112/162 |
| 6,973,887 | B2 * | 12/2005 | Rattay | ..... | 112/197 |
| 7,107,919 | B2 * | 9/2006 | Hasegawa | ..... | 112/100 |
| 7,841,283 | B2 * | 11/2010 | Kawaguchi et al. | ..... | 112/221 |

FOREIGN PATENT DOCUMENTS

| | | | |
|---|---|---|---|
| JP | 405007682 | A * | 1/1993 |
| JP | 10-99569 | | 4/1998 |
| JP | 02001104673 | A * | 4/2001 |
| JP | 02003169982 | A * | 6/2003 |

* cited by examiner

*Primary Examiner* — Ismael Izaguirre
(74) *Attorney, Agent, or Firm* — Drinker Biddle & Reath LLP

(57) ABSTRACT

A threading device of a sewing machine is provided. The threading device includes a threading hook which moves forward to enter an eye of a needle to catch a needle thread, and moves rearward with the needle thread being caught to insert the needle thread through the eye, a threading shaft which holds the threading hook, an operating member which is operated to move the threading shaft, a threading operation mechanism which transmits the movement of the threading shaft to the threading hook to move the threading hook back and forth, and a restricting device which makes the threading operation mechanism inoperable when the spreader mechanism is attached to the sewing machine main body, and makes the threading operation mechanism operable when the spreader mechanism is detached from the sewing machine main body.

8 Claims, 10 Drawing Sheets

"PRIOR ART"

THREADING DEVICE OF SEWING MACHINE

CROSS-REFERENCE TO RELATED APPLICATION

The present application claims priority from Japanese Patent Application No. 2007-236739 filed on Sep. 12, 2007, the entire content of which is incorporated herein by reference.

FIELD OF INVENTION

The present invention relates to a threading device of a sewing machine which has a plurality of needles and can form covering stitches.

DESCRIPTION OF RELATED ART

A related art sewing machine is configured to form covering stitches on a workpiece. The sewing machine includes a plurality of needles arranged in a direction intersecting with a direction in which the workpiece is to be fed, a spreader which arcuately moves from a side to a front of the needles above the workpiece, and a looper which rotates below a throat plate on which the workpiece is placed. The plurality of needles moves up and down with needle threads being inserted therethrough, respectively. The spreader arcuately moves in synchronization with the up and down movement of the needles to interlace a covering thread with the needle threads. Further, the looper rotates in synchronization with the arcuate movement of the spreader to interlace a looper thread with the needle threads below the throat plate.

In such a sewing machine, in order to interlace the covering thread with the needle threads using the spreader, the needles and the spreader need to be operated at specific timings. Therefore, as shown in FIG. 12, a link member 203 is coupled to a needle bar 202 which holds the needles 201 (see, e.g., JP 10-99569 A). The link member 203 converts the up and down movement of the needle bar 202 into a movement around a horizontal axis. A bevel gear 204 is attached to a tip end portion of the link member 203. The bevel gear 204 meshes with another bevel gear 205. The movement of the bevel gear 204 around a horizontal axis is converted into a movement of the bevel gear 205 around a vertical axis. A spreader 207 is fixed to a rotation shaft 206 of the bevel gear 205 by screwing. With this mechanism, the spreader 207 horizontally moves across a region below the needles 201, and interlaces the covering thread with the needle threads to form covering stitches on a workpiece.

In order to form the covering stitches on the workpiece, it is necessary to move the spreader across a region immediately below the needles, so that a distance between the needles and the spreader is short. Therefore, when inserting the needle threads through the eyes of the respective needles by using a threading device, the threading device hits the spreader. Accordingly, when inserting the needle threads through the needles by using the threading device, an operator needs to detach the spreader.

However, there has been a problem that, when the operator operates the threading device by mistake while the spreader is attached, the threading device collides with the spreader, resulting in breakage of either or both of the threading device and the spreader.

SUMMARY OF INVENTION

It is an object of the present invention to provide a threading device of a sewing machine, which can prevent a collision between the threading device and a spreader to prevent them from breaking.

According to an aspect of the present invention, a threading device of a sewing machine having a sewing machine main body, a needle through which a needle thread is inserted, and a spreader mechanism which interlaces a covering thread with the needle thread to form top covering stitches, in which the spreader mechanism is attachable and detachable with respect to the sewing machine main body, is provided. The threading device includes a threading hook which moves forward to enter an eye of the needle to catch the needle thread, and moves rearward with the needle thread being caught to insert the needle thread through the eye, a threading shaft which holds the threading hook an operating member which is operated to move the threading shaft, a threading operation mechanism which transmits the movement of the threading shaft to the threading hook to move the threading hook back and forth, and a restricting device which makes the threading operation mechanism inoperable when the spreader mechanism is attached to the sewing machine main body, and makes the threading operation mechanism operable when the spreader mechanism is detached from the sewing machine main body.

Other aspects and advantages of the invention will be apparent from the following description, the drawings and the claims.

DETAILED DESCRIPTION

Hereinafter, embodiments of the present invention will be described with reference to the drawings.

First Embodiment

As shown in FIGS. 1 to 5, a threading device 1 according to a first embodiment of the present invention is provided near a jaw portion of a sewing machine 100. The threading device 1 inserts needle threads (stitching threads) through eyes of needles below the jaw portion. The sewing machine 100 equipped with the threading device 1 can implement both overlock stitching and cover stitching sewing with a single machine. The sewing machine 100 includes five needles 80*a*, 80*b*, 80*c*, 80*d*, 80*e* which are arranged in lines. Each of the needles 80*a* to 80*e* are held by a single needle bar 8, and is moved up and down by driving a sewing machine motor to insert the respective needle threads through a workpiece.

Figure 4:
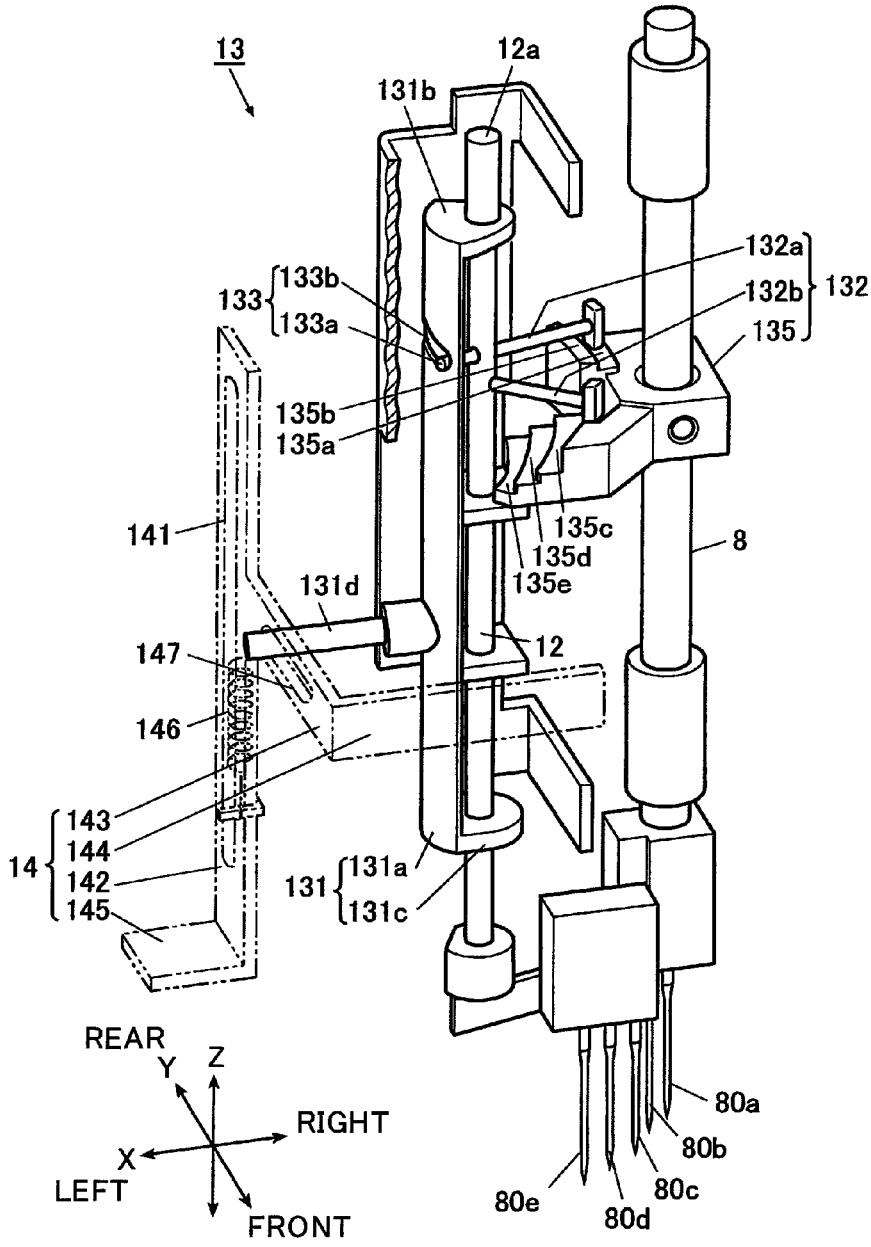
FIG. 4 is a perspective view of a threading operation mechanism.

As shown in FIG. 4, in the following description, a direction parallel to the longitudinal direction of the needles 80*a* to 80*e* is defined as a Z-axis direction, a direction orthogonal to the longitudinal direction of the needles 80*a* to 80*e* and along which the needles 80*a* to 80*e* are arranged is defined as an X-axis direction (a first direction), and a direction orthogonal to the needles 80*a* to 80*e* and also orthogonal to the X-axis direction is defined as a Y-axis direction (a second direction).

As shown in FIGS. 1 to 6, the sewing machine 100 includes the threading device 1 which inserts the needle threads through the eyes of the needles 80*a* to 80*e*, a top covering shaft mechanism 2 (see FIG. 2) for forming covering stitches on the workpiece, a spreader mechanism 4 (see FIG. 2) which is detachably attached to the top covering shaft mechanism 2 from below, an operating member 6 (see FIG. 2) which is attached to the spreader mechanism 4 such that the operating member 6 can be operated to rotate between a position at which the spreader mechanism 4 is locked with respect to the top covering shaft mechanism 2 and a position at which the spreader mechanism 4 separates from the top covering shaft mechanism 2, a presser 81 (see FIGS. 1 and 6) which is disposed below the needles 80*a* to 80*e* to press the workpiece on a throat plate, and a fixed thread guide 82 and a needle hold thread guide 83 which guide a covering thread to the spreader mechanism 4.

Threading Device

Figure 3:
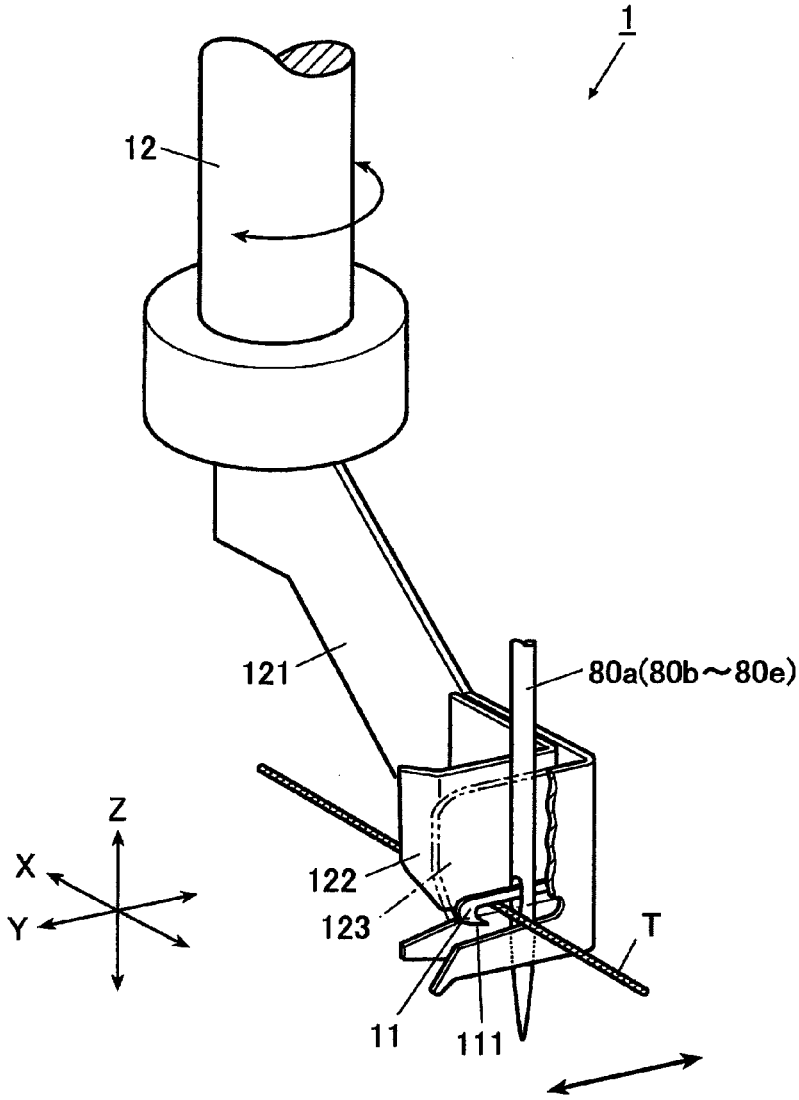
FIG. 3 is a perspective view around a threading hook of a threading device.
Figure 5:
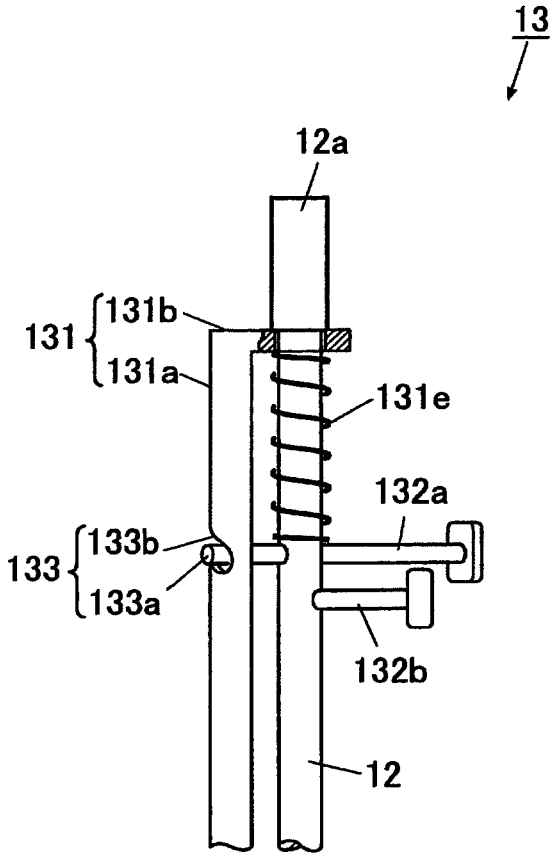
FIG. 5 is another perspective view of a threading operation mechanism.

As shown in FIGS. 3 to 5, the threading device 1 is disposed adjacent to the needle bar 8. The threading device 1 includes a threading hook 11 which forwardly moves to enter the eyes of the needles 80*a* to 80*e* and to catch the corresponding needle thread and which rearwardly moves while the needle thread is being caught to insert the needle thread through the corresponding eye, a threading shaft 12 which holds the threading hook 11, a threading operation mechanism 13 which transmits a movement of the threading shaft 12 to the threading hook 11 to move the threading hook 11 back and forth, an operation lever 14 (another operating member) which is operated to move the threading shaft 12, and a restricting device 16 which makes the threading operation mechanism 13 inoperable when the spreader mechanism 4, which moves to interlace the covering thread with the needle threads to form top covering stitches and is attachable to and detachable from a sewing machine main body 10 via the top covering shaft mechanism 2, is attached to the top covering shaft mechanism 2, and makes the threading operation mechanism 13 operable when the spreader mechanism 4 is detached from the top covering shaft mechanism 2.

Threading Hook and Threading Shaft

FIG. 3 is an enlarged perspective view of a lower end portion of the threading shaft 12. The threading shaft 12 has a shape like a round bar, and is disposed parallel to the needle bar 8 along the Z-axis direction near the needle bar 8. The threading hook 11 is coupled to the lower end portion of the threading shaft 12 via a hook holding arm 121. The hook holding arm 121 is formed to extend downward from a lower end of the threading shaft 12 in a radial direction of a circle having a center at the threading shaft 12.

The threading hook 11 is provided on a distal end portion of the hook holding arm 121, and is formed such that a tip end portion of the threading hook 11 is oriented toward a tangent direction of the circle having the center at the threading shaft 12. Because the threading hook 11 is provided to be directed toward the tangent direction on a circumference of the circle having the center at the threading shaft 12, the threading hook is forwardly moved with its tip end portion directed forward by a forward rotation of the threading shaft 12, and is rearwardly moved by a reverse rotation of the threading shaft 12.

The tip end portion of the threading hook 11 is formed with a hooked barb 111. The threading hook 11 is inserted in the eye of one of the needles 80*a* to 80*e* from the tip end portion and catches the needle thread T with the barb 111 of the tip end portion by the forward movement, and draws the needle thread T which has been caught into the eye to insert the thread by the rearward movement.

A pair of guide plates 122, 123, whose plane surfaces are parallel to both the threading hook 11 and the threading shaft 12, are provided at the distal end portion of the hook holding arm 121 and on respective sides of the threading hook 11. The guide plates 122, 123 are bent in such a shape that they become wider toward their distal end portions, and are arranged such that a gap therebetween is slightly wider than a normal thickness of the needles 80*a* to 80*e*. By means of the guide plates 122, 123, the eye of one of the needles 80*a* to 80*e* is accurately guided to the threading hook 11 during the forward movement.

For the purpose of guiding the needle thread, cuts are formed on the respective guide plates 122, 123 along a direction in which the threading hook 11 extends at a position slightly below the threading hook 11. This makes it possible to guide the needle thread T to an appropriate height so as to be caught by the threading hook 11 during the forward movement.

Threading Operation Mechanism

As shown in FIGS. 4 and 5, the threading operation mechanism 13 downwardly moves the threading shaft 12 by pulling down the operation lever 14, whereby a threading operation to the eye of the needles 80*a* to 80*e* is carried out by the movement of the threading shaft 12. The threading operation mechanism 13 includes a threading slide guide 131 which downwardly moves together with the threading shaft 12 in accordance with a downward operation from the operation lever 14, a height adjusting mechanism 132 which blocks the downward movement of the threading shaft 12 at a plurality of heights corresponding to heights of the eyes of the respective needles 80*a* to 80*e*, and a threading cam mechanism 13 which rotates the threading shaft 12 in a direction in which the threading hook 11 is moved forward when only the threading slide guide 131 moves downward with respect to the threading shaft 12.

Threading Slide Guide

The threading slide guide 131 includes a back plate 131*a* which is vertically long and has an arc sectional shape, plate-like support portions 131*b*, 131*c* which are integrally provided on upper and lower end portions of the back plate 131*a* and each being formed with a through hole through which the threading shaft 12 is inserted, and an engagement shaft 131*d* which is leftwardly extended along the X-axis direction from the back plate 131*a* to engage with the operation lever 14.

The support portions 131*b*, 131*c* are in a form of a plate parallel to the X-Y plane, and the through holes through which the threading shaft 12 is inserted are formed. The support portions 131*b*, 131*c* are coupled to the threading shaft 12 via the through holes such that the threading slide guide 131 is slidable along and with respect to the threading shaft 12. A compression coil spring 131*e* is interposed between the upper support portion 131*b* and a first guide pin 132*a* which is provided on the threading shaft 12 and will be described below. A stopper 12*a* is provided on an upper end portion of the threading shaft 12, and is brought into contact with an upper surface of the support portion 131*b*. Accordingly, the threading shaft 12 and the threading slide guide 131 are relatively biased such that the threading shaft 12 is downwardly pressed and the threading slide guide 131 is upwardly pressed.

Height Adjusting Mechanism

The height adjusting mechanism 132 has a function of blocking the downward movement of only the threading shaft 12 in order to actuate the threading cam mechanism 133, and a function of adjusting, when threading each of the needles 80*a* to 80*e*, the height of the threading hook 11 in cooperation with a positioning mechanism (not shown) which positions the threading shaft 12 in accordance with the arrangement of the needles 80*a* to 80*e* when threading each of the needles 80*a* to 80*e*. More specifically, the height adjusting mechanism 132 includes first and second guide pins 132*a*, 132*b* provided on the threading shaft 12, and a lower side threading guide 135 having five contact portions 135*a* to 135*e* against which either one of the guide pins 132*a*, 132*b* is brought into contact from above.

The first and second guide pins 132*a*, 132*b* are provided perpendicular to the threading shaft 12, and the first guide pin 132*a* is arranged on an upper side. Further, the two guide pins 132*a*, 132*b* are arranged on the threading shaft 12 at different angles from the threading shaft 12 on the X-Y plane.

The lower side threading guide 135 is a block-like member which is fixedly supported on the needle bar 8 and has the five contact portions 135*a* to 135*e* on an upper portion thereof. The contact portion 135*a* is arranged such that the first guide pin 132*a* moves downward and is brought into contact thereto when the threading shaft 12 is positioned to thread the needle 80*a*. The contact portion 135*b* is arranged such that the first guide pin 132*a* moves downward and is brought into contact thereto when the threading shaft 12 is positioned to thread the needle 80*b*. The contact portion 135*c* is arranged such that the second guide pin 132*b* moves downward and is brought into contact thereto when the threading shaft 12 is positioned to thread the needle 80*c*. The contact portion 135*d* is arranged such that the second guide pin 132*b* moves downward and is brought into contact thereto when the threading shaft 12 is positioned to thread the needle 80*d*. The contact portion 135*e* is arranged such that the second guide pin 132*b* moves downward and is brought into contact thereto when the threading shaft 12 is positioned to thread the needle 80*e*.

A surface of each the contact portions 135*a* to 135*e* is formed into an arcuate shape so that each of the guide pins 132*a*, 132*b* can maintain its contacting state when the threading shaft 12 is brought into contact and rotates.

Further, because the contact portions 135*a* to 135*e* determine the heights of the threading shaft 12 and the threading hook 11 upon threading, heights of the respective surfaces thereof are set to be different so as to correspond to the heights of the eyes of the respective needles 80*a* to 80*e*.

The contact portions 135*a*, 135*b* and the other contact portions 135*c*, 135*d*, 135*e* are arranged apart from each other so as to correspond to an open angle between the guide pins 132*a*, 132*b* around the threading shaft 12. Thus, depending on the number of the guide pins, a plurality of contact portions are arranged in a dispersed manner to avoid interference in the arrangement of the contact portions.

While there are two guide pins 132*a*, 132*b*, the first guide pins 132*a* and the second guide pins 132 are made different in height from each other such that, when one of the guide pins is brought into contact with the corresponding one of the contact portions, the other does not contact any of the contact portions.

Threading Cam Mechanism

The threading cam mechanism 133 includes an engagement protrusion 133*a* horizontally protruding from the threading shaft 12 toward the back plate 131 of the threading slide guide 131, and a slot 133*b* (a groove cam) formed in the back plate 131*a* of the threading slide guide 131.

The engagement protrusion 133*a* is inserted in the slot 133*b* which is formed by penetrating through back and front of the back plate 131*a*, and is designed to have a length that penetrates to the outer side of the back plate 131*a*.

The slot 133*b* is formed such that its longitudinal direction is inclined in the vertical direction. The engagement protrusion 133*a* is normally maintained to be positioned at a lower end portion of the slot 133*b* due to an action of the compression coil spring 131*e* provided between the threading shaft 12 and the threading slide guide 131. The slot 133*b* is inclined in a direction which causes the threading shaft 12 to be displaced in a rotating direction in which the threading hook 11 is forwardly moved when the engagement protrusion 133*a* moves up along the slot 133*b*. In other words, the threading hook 11 is moved forward by a clockwise rotation of the threading shaft 12 when seen in a plan view, so that the slot 133*b* is upwardly inclined toward the rear in the Y-axis direction.

It is when the threading slide guide 133 moves downward relative to the threading shaft 12 that the engagement protrusion 133*a* moves upward along the slot 133*b*. Due to the action of the compression coil spring 131*e* provided between the threading shaft 12 and the threading slide guide 131 and an action of the stopper 12*a* on the upper end portion of the threading shaft 12, the threading shaft 12 and the threading slide guide 131 move up and down together unless a force larger than the pressing force of the compression coil spring 131*e* is applied. Therefore, the height adjusting mechanism 132 is provided in the downward movement path of the threading shaft 12 to block, when a downward movement is given to the threading slide guide 131 and the threading shaft 12 from the operation lever 14, the downward movement of only the threading shaft 12 on the way. At this time, when a pressing force that is larger than that of the compression coil spring 131*e* is further applied from the operation lever 14, the threading slide guide 131 is downwardly moved relative to the threading shaft 12, the threading shaft 12 is rotated by the action of the threading cam mechanism 133, and the threading hook 11 is forwardly moved to performs threading. When the operation lever 14 is released, the threading hook 11 is rearwardly moved back due to a restoring force of the compression coil spring 131*e*.

Operation Lever

As shown in FIG. 4, the operation lever 14 is formed with a slot 141 which extends in the vertical direction. The operation lever 14 is supported to be vertically movable with respect to a frame of the threading device 1. The operation lever 14 includes a main body portion 142 which is long in the vertical direction, an arm portion 143 which extends from an intermediate portion of the main body portion 142 in a direction (the Y-axis direction) perpendicular to the main body 142, and a thread holding member operating portion 144 which is bent at a right angle from a tip end portion of the arm 143 to extend in the X-axis direction.

The above-described slot 141 is formed to penetrate through the main body 142. A lower end portion of the main body portion 142 is bent at a right angle to form a protruding portion 145 extending in the X-axis direction from which the downward pressing operation is carried out. Further, the main body portion 142 is coupled to the frame via a tension spring 146, and is upwardly biased by an tension force.

The arm portion 143 is formed with a slot 147 which penetrates therethrough along the Y-axis direction, and the engagement shaft 131*d* extending from the threading slide guide 131 is inserted therein. Therefore, the downward movement operation given from the operation lever 14 is transmitted from the arm portion 143 to the threading slide guide 131 and the threading shaft 12 via the engagement shaft 131*d*.

The thread holding member operating portion 144 is for moving the thread holding member toward the needles 80*a* to 80*e* when forwardly moving the threading hook 11. By providing the thread holding member operating portion 144 on the operation lever 14, interlocking of the forward movement of the threading hook 11 and the approaching movement of the thread holding member is implemented.

Restricting Device

Figure 1:
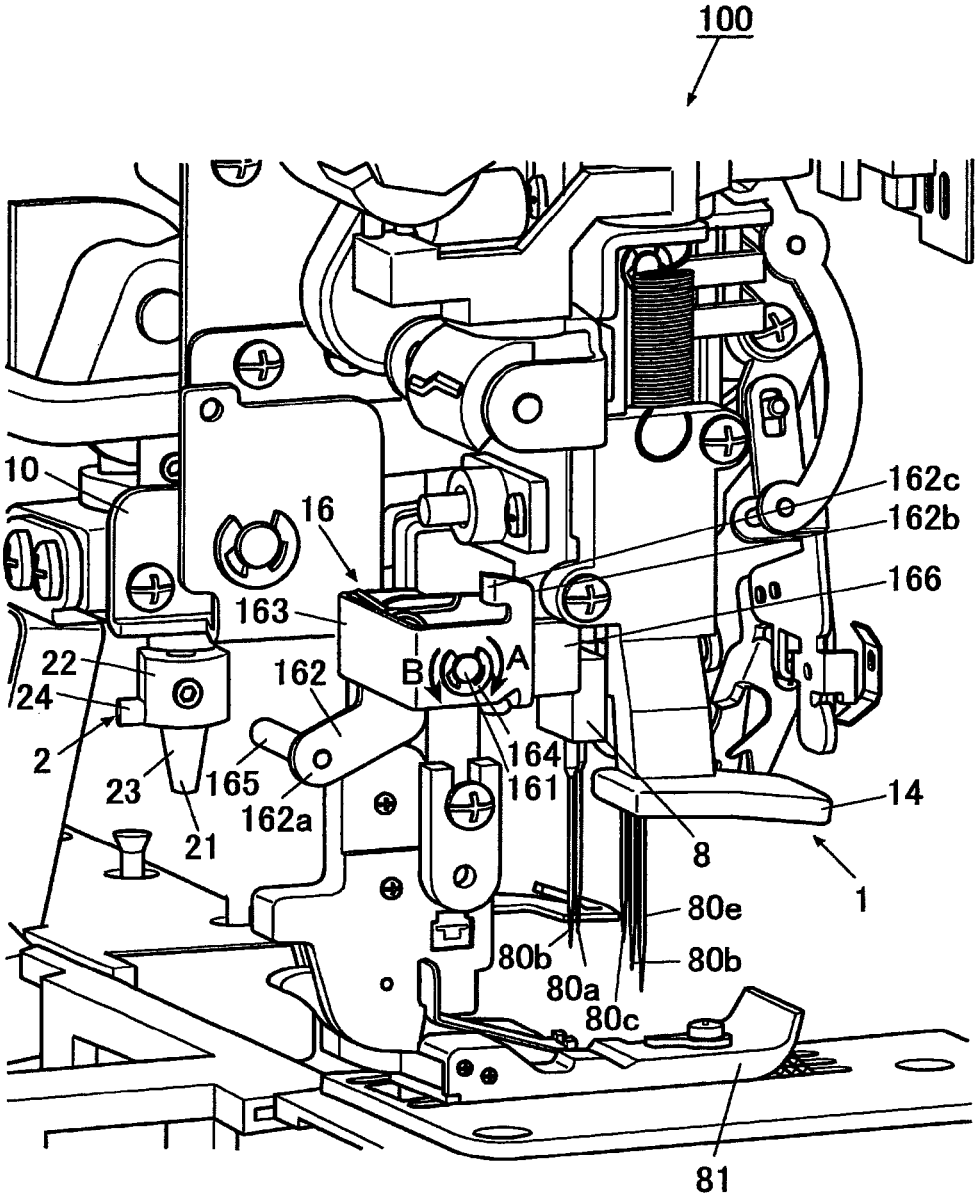
FIG. 1 is a perspective view near a jaw portion of a sewing machine according to a first embodiment of the present invention.
Figure 2:
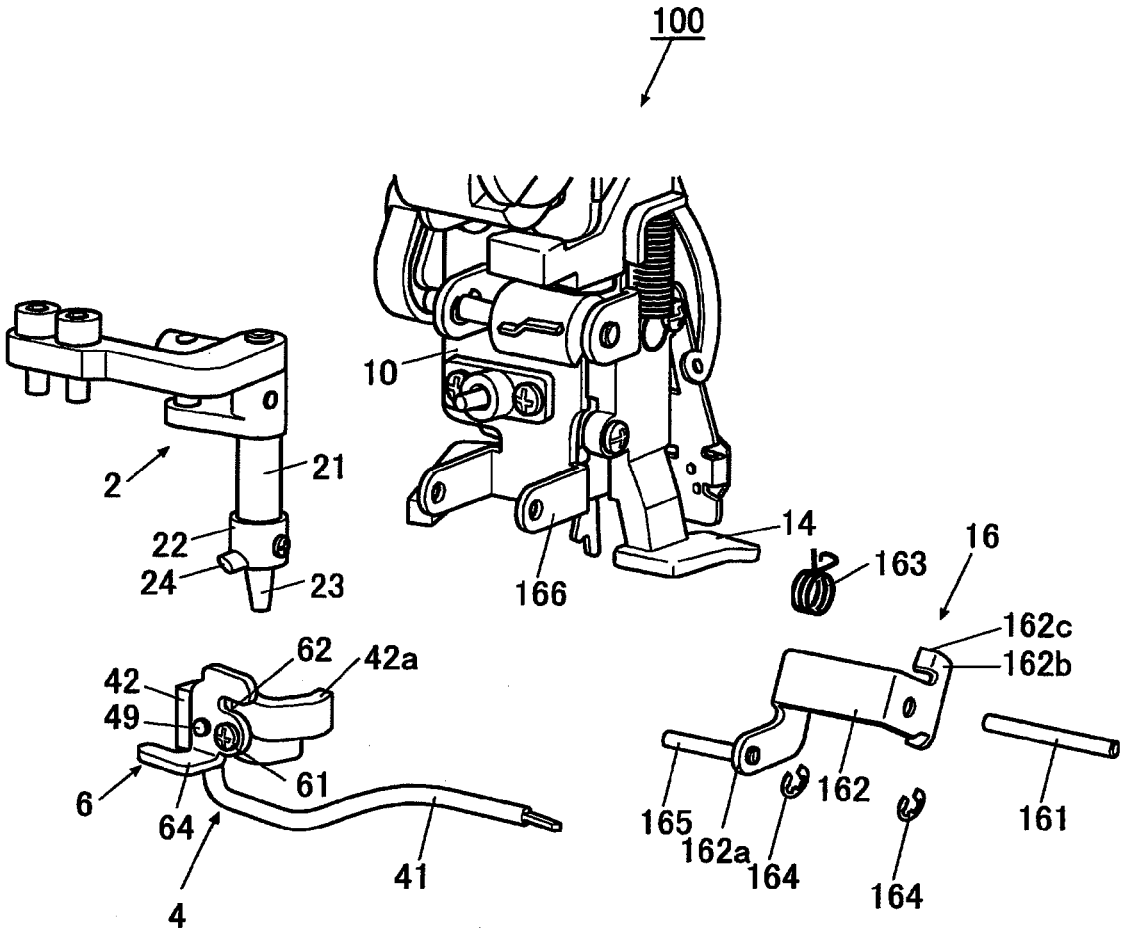
FIG. 2 is an exploded perspective view of the sewing machine, showing a sewing machine main body, a top covering shaft mechanism, a spreader mechanism, and a restricting device.

As shown in FIGS. 1 and 2, the restricting device 16 includes a rotation shaft 161 inserted through the sewing machine main body 10, a lock member 162 rotatably provided on the rotation shaft 161, a spring 163 (a biasing member) which biases the lock member 162 to rotate in one direction, an E ring 164 which prevents the lock member 162 from dropping off the rotation shaft 161, a contact shaft 165 provided on one end portion 162*a* of the lock member 162, and a stopper 166 which is fixed to the sewing machine main body 10 and arranged on a rotation path of the other end portion 162*b* of the lock member 162. The lock member 162 is formed by bending a plate material, and when seen from the front, the rotation shaft 161 is inserted at a position between the one end portion 162*a* and the other end portion 162*b*.

The contact shaft 165 is provided on the one end portion 162*a* of the lock member 162 so as to be substantially parallel to the rotation shaft 161. This contact shaft 165 is provided at a position where it interferes with the spreader mechanism 4 when attaching the spreader mechanism 4 to the top covering shaft mechanism 2. When attaching the spreader mechanism 4 to the top covering shaft mechanism 2, the contact shaft 165 is pushed by the spreader mechanism 4 and is moved upward.

The other end portion 162*b* of the lock member 162 is formed with a claw portion 162*c* which moves in and out of the movement path of the operation lever 14 in accordance with the rotation of the lock member 162. The claw portion 162*c* is formed such that it is rotatable to a position where it is able to contact the operation lever 14. The claw portion 162*c* is formed by bending such that a tip end thereof extends toward the stopper 166.

The stopper 166 is provided on a rotational movement path of the claw portion 162*c*, and when the claw portion 162*c* is moved into the movement path of the operation lever 14, the stopper 166 restricts the movement of the claw portion 162*c* so as to prevent the claw portion 162*c* from further moving from this position.

The stopper 166 is formed into a plate shape, and is provided at a position away from the movement path of the operation lever 14. Therefore, the operation lever 14 does not contact the stopper 166, but only a part of the claw portion 162*c* is brought into contact with the stopper 166 to restrict the lock member 162 from rotating.

Accordingly, when attaching the spreader mechanism 4 to the top covering shaft mechanism 2, the spreader mechanism 4 is brought into contact with the contact shaft 165 and lifts up the contact shaft 165. Due to the upward movement of the contact shaft 165, the one end portion 162*a* of the lock member 162 rotates in a clockwise direction (a direction A in FIG. 1) when seen from the front. Due to this rotation, the other end portion 162*b* rotates and moves into the movement path of the operation lever 14 to restrict the operation lever 14 from moving downward. In other words, due to the rotation of the lock member 162, the other end portion 162*b* of the lock member 162 can move in and out of the movement path of the operation lever 14.

The spring 163 is provided along the rotation shaft 161 and the lock member 162, and biases the lock member 162 in a counterclockwise direction (a direction B in FIG. 1) when seen from the front. Therefore, when the spreader mechanism 4 is not attached to the top covering shaft mechanism 2, the contact shaft 165 is not being pushed up so that the lock member 162 is rotated counterclockwise and the claw portion 162*c* of the other end portion 162*b* does not move into the movement path of the operation lever 14. Accordingly, the lock member 162 can restrict the movement of the operation lever 14 such that the operation lever 14 does not move only when the spreader mechanism 4 is attached to the top covering shaft mechanism 2.

Top Covering Shaft Mechanism

Figure 6:
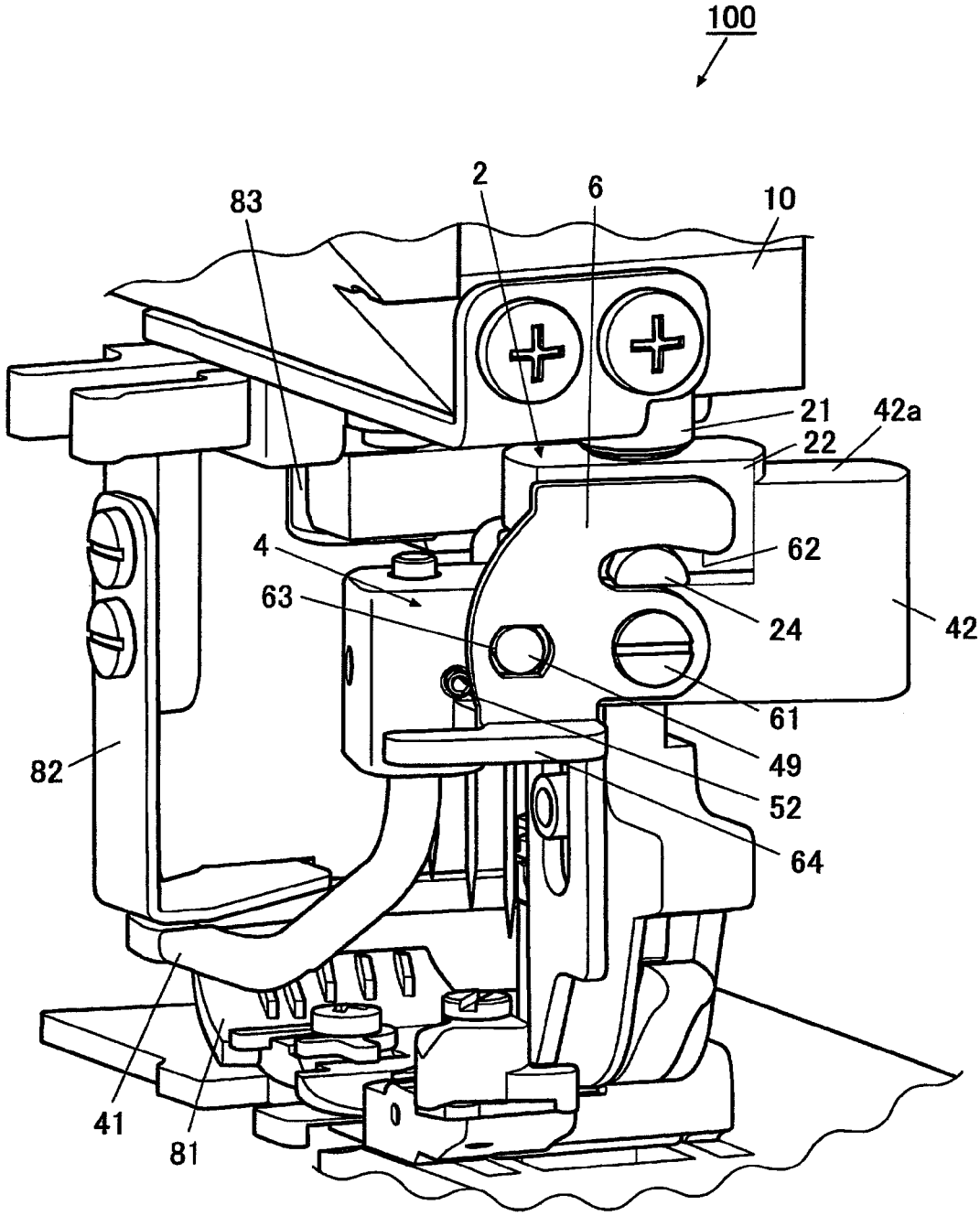
FIG. 6 is a perspective view of the top covering shaft mechanism, the spreader mechanism, and an operating member.

As shown in FIGS. 2 and 6, the top covering shaft mechanism 2 includes a top covering shaft 21 provided on a lower end of the jaw portion of the sewing machine main body 10 to extend downward, and a locking base 22 through which the top covering shaft 21 is inserted. The top covering shaft 21 is formed into a cylindrical column shape, and a lower end portion thereof is formed to be a tapered portion 23 which is tapered toward an axial center such that a sectional area is reduced. The top covering shaft 21 is inserted through the locking base 22 from above, and the tapered portion 23 is formed to project downward from a lower end face of the locking base 22. The locking base 22 includes a protrusion 24 protruding outward from a side surface of a lower end portion thereof. The protrusion 24 is formed into a semicircular shape when seen in a front view, and the arc portion thereof is oriented upward. When the spreader mechanism 4 is attached to the top covering shaft mechanism 2, the protrusion 24 engages with the operating member 6 to prevent the spreader mechanism 4 from dropping off.

Spreader Mechanism

As shown in FIGS. 2 and 6, the spreader mechanism 4 includes a spreader 41 which catches the covering thread, and a spreader support base 42 which supports the spreader 41. The spreader 41 is formed into a rod shape, and is bent at a plurality of positions thereof. A tip end portion of the spreader 41 is formed with a claw portion to catch the covering thread. The spreader 41 is inserted into the spreader support base 42 so as to be slidable in the vertical direction, so that the height of the spreader 41 can be adjusted.

The top covering shaft 21 is fitted into the spreader support base 42 such that the tapered portion 23 is accommodated. The operating member 6 is rotatable attached to a side surface of the spreader support base 42 with a set screw 61 such that the operating member can be operated to rotate between a position at which the spreader mechanism 4 is locked onto the top covering shaft mechanism 2 and a position at which the spreader mechanism 4 is detached from the top covering shaft mechanism 2. The details of the operating member 6 will be described later. A portion of the spreader support base 42 is formed to upwardly bulge to a position where it contacts the side surface of the locking base 22. An upper surface of this bulged push-up portion 42*a* is brought into contact with the contact shaft 165 provided on the lock member 162 and pushes up the contact shaft 165 when attaching the spreader mechanism 4 to the top covering shaft mechanism 2.

On the spreader support base 42, a latching member 49 whose tip end portion is able to protrude out from a front surface of the spreader support base 42 and which is movable between a position at which it is fitted into the operating member 6 and a position at which it disengages with the operating member 6 is provided. The latching member 49 is biased by a spring or the like so as to project with respect to the spreader support base 42 and the operating member 6.

The front surface of the spreader support base 42 is provided with a stopper 52 which restricts a rotation range of the operating member 6. This stopper 52 is provided at a position at which the stopper 52 is brought into contact with the operating member 6 only when the operating member 6 and the protrusion 24 are disengaged from each other and the operating member 6 is rotated to a position at which the spreader mechanism 4 is detachable from the top covering shaft mechanism 2.

Operating Member

As shown in FIG. 6, the operating member 6 is rotatably attached to the front surface side of the spreader support base 42 with the set screw 61. The operating member 6 engages with the protrusion 24 and prevents the spreader mechanism 4 from separating from the top covering shaft mechanism 2 when the spreader mechanism 4 is at a position at which it is locked onto the top covering shaft mechanism 2. When the spreader mechanism 4 is at a position at which it is detachable from the top covering shaft mechanism 2, the operating member 6 is disengaged from the protrusion 24.

The operating member 6 is formed with a hook portion 62 having a hook shape which engages with the protrusion 24 when the spreader mechanism 4 is at the position at which it is locked onto the top covering shaft mechanism 2. The hook portion 62 is formed into a shape which is hung on the protrusion 24 when engaging with the protrusion 24. This shape restricts the spreader mechanism 4 from moving downward, and prevents the spreader mechanism 4 from dropping from the top covering shaft mechanism 2.

The operating member 6 is formed with a latch hole 63 for making the tip end of the latching member 49 pop out toward the operating member 6 and engage with the operating member 6 when the hook portion 62 is engaged with the protrusion 24. In other words, when the latching member 49 is fitted into the latch hole 63, the spreader mechanism 4 is at the position at which it is locked onto the top covering shaft mechanism 2, that is, the hook portion 62 of the operating member 6 is engaged with the protrusion 24. Therefore, when the latching member 49 is not fitted into the latch hole 63, nothing restricts the rotation range of the operating member 6, so that the operating member 6 can freely rotate until it contacts the stopper 52. The operating member 6 is formed with a tab 64 which is held by an operator when rotating the operating member 6.

Restriction of Threading Device Operation by Threading Device

Next, the operation of the threading device 1 which is restricted by the restricting device 16 will be described.

As shown in FIG. 1, before attaching the spreader mechanism 4 to the top covering shaft mechanism 2, the lock member 162 is biased in the counterclockwise direction in a front view by the spring 163, and the claw portion 162*c* of the other end portion 162*b* is positioned on the upper side away from the vertical movement path of the operation lever 14. At this time, the contact shaft 165 provided on the one end portion 162*a* of the lock member 162 is at the lowest position.

Figure 7:
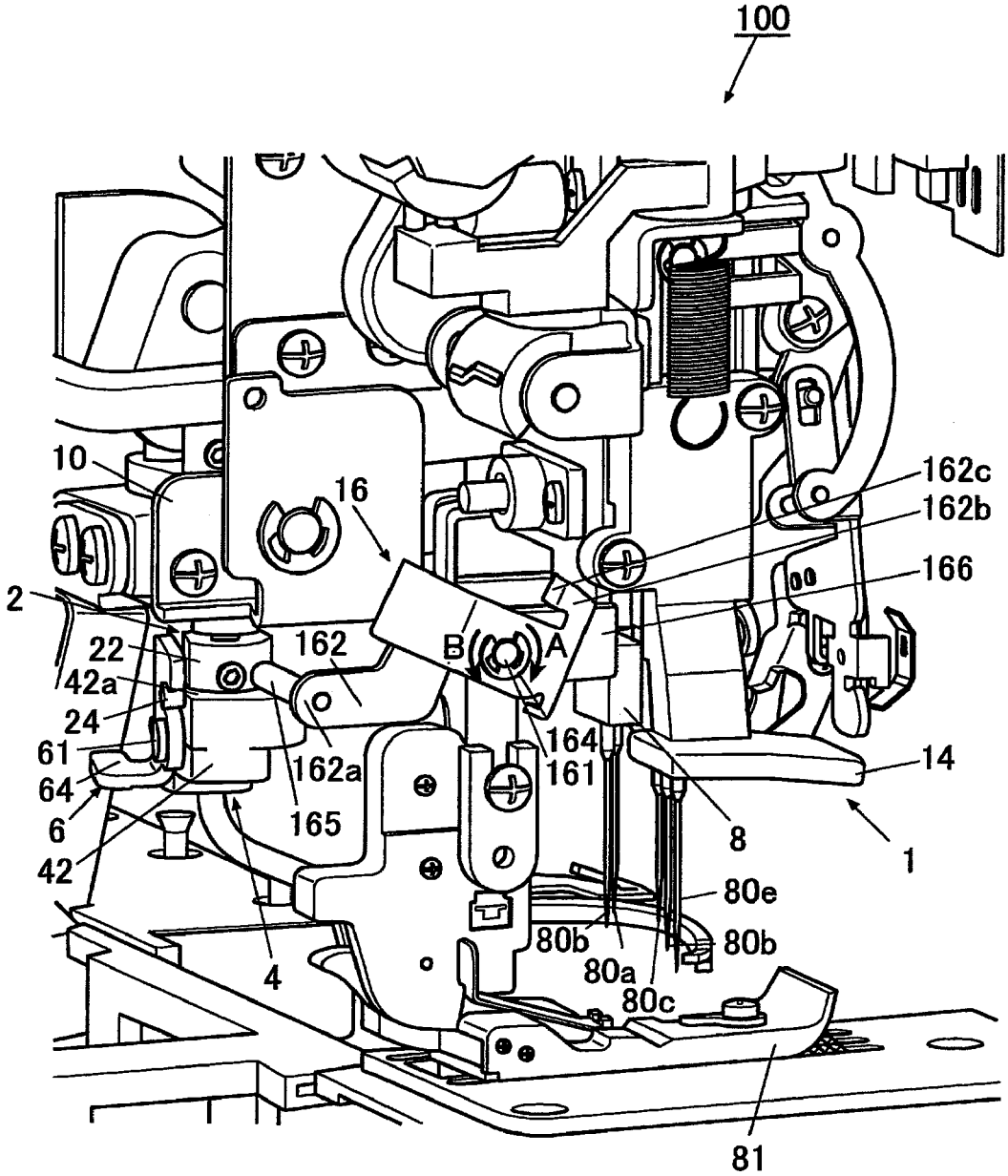
FIG. 7 is a view illustrating a movement of a lock member when attaching the spreader mechanism to the top covering shaft mechanism.
Figure 8:
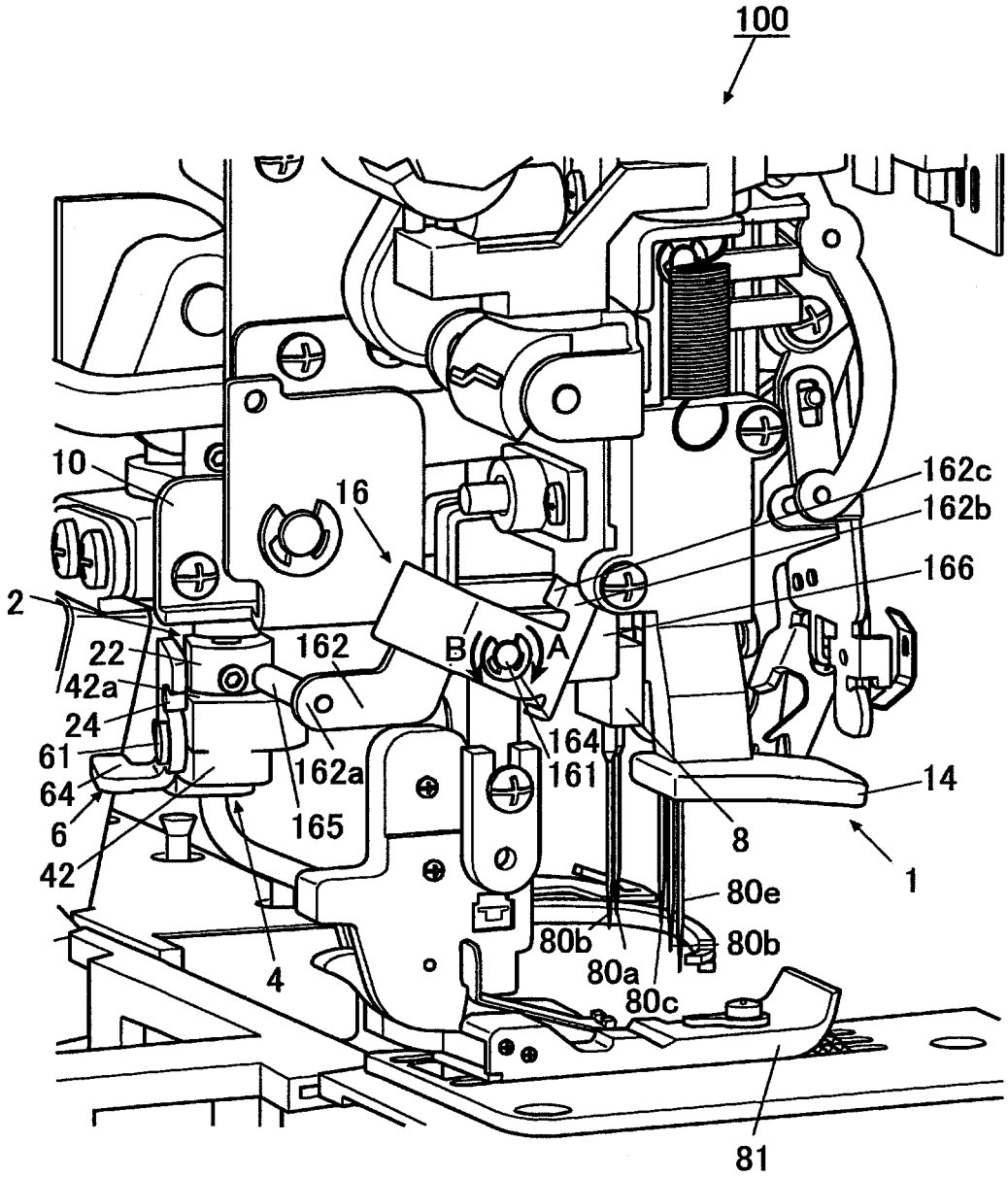
FIG. 8 is a view illustrating a state in which a downward movement of an operation lever is restricted by the lock member when the operation lever is moved downward for threading in a state of FIG. 7.

Then, as shown in FIG. 7, when the spreader mechanism 4 is attached to the top covering shaft mechanism 2 provided on the sewing machine main body 10, the push-up portion 42*a* of the spreader mechanism 4 pushes up the contact shaft 165 against the biasing force of the spring 163. When the contact shaft 165 is pushed up, the lock member 162 to which the contact shaft 165 is fixed rotates in the clockwise direction around the rotation shaft 161 in a front view, and the claw portion 162*c* is also rotated in the clockwise direction around the rotation shaft 161 in the front view. Accordingly, the claw portion 162*c* is moved into the vertical movement path of the operation lever 14. In a case in which an attempt is made to perform threading by the threading device 1 in this state, as shown in FIG. 8, when the operation lever 14 is pushed down, the operation lever 14 is brought into contact with the claw portion 162*c* before moving downward to the position necessary for threading, and is restricted from moving further downward. At this time, the claw portion 162*c* is made to contact the stopper 166 which is fixed to the sewing machine main body 10, it cannot rotate further. Accordingly, the threading is restricted only when the spreader mechanism 4 is attached to the top covering shaft mechanism 2.

According to the threading device 1 of the first embodiment, the restricting device 16 restricts the operation lever 14 from moving when the spreader mechanism 4 is attached to the top covering shaft mechanism 2, and allows the operation lever 14 to move when the spreader mechanism 4 is detached from the top covering shaft mechanism 2.

Accordingly, when the spreader 41 is attached to the top covering shaft mechanism 2, that is, in the state in which the threading device 1 and the spreader mechanism 4 collide with each other if the threading is performed, the restricting device 16 prohibits the threading.

Therefore, even if an operator operates the threading device 1 by mistake while the spreader 41 is attached to the top covering shaft mechanism 2, a collision between the threading device 1 and the spreader 41 is prevented by the restricting device 16, so that breakage thereof can be prevented.

According to the threading device 1 of the first embodiment, moreover, when attaching the spreader mechanism 4 to the top covering shaft mechanism 2, the one end portion 162*a* of the lock member 162 is brought into contact with the spreader mechanism 4 and rotates in one direction, and due to this rotation, the other end portion 162*b* rotates into the movement path of the operation lever 14 and restricts the operation lever 14 from moving.

Accordingly, whether the threading is allowed or not can be determined by attaching and detaching the spreader mechanism 4 with respect to the top covering shaft mechanism 2.

Further, because the threading can be restricted depending only on whether the spreader mechanism 4 is attached to the top covering shaft mechanism 2, additional operation burden is not imposed on an operator.

Second Embodiment

Figure 9:
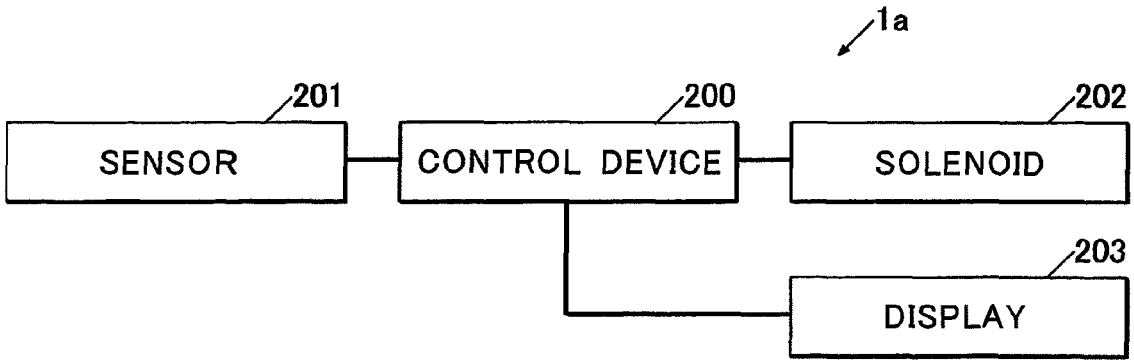
FIG. 9 is a block diagram of a configuration around a control device of the threading device of the sewing machine according to a second embodiment of the present invention.

Next, a threading device of a sewing machine according to a second embodiment of the present invention will be described. Components similar to those in the first embodiment are indicated by the same reference numerals, and description thereof will be omitted. FIG. 9 is a block diagram of the threading device 1*a* of the second embodiment.

The threading device 1*a* includes a control device 200. A sensor 201 is coupled to the control device 200, and detects that the spreader mechanism 4 is attached to the top covering shaft mechanism 2. The sensor 201 is provided on the top covering shaft mechanism 2, and when it detects that the spreader mechanism 4 is attached to the top covering shaft mechanism 2, it transmits a detection signal to the control device 200.

A solenoid 202, from which a plunger moves in and out of the movement path of the operation lever 14, is coupled to the control device 200. The solenoid 202 is provided on the sewing machine main body, and is driven in response to a drive command signal from the control device 200 to move the plunger in and out.

A display 203 is coupled to the control device 200 to notify a user that the spreader mechanism 4 is attached, and allows the user to input a command therefrom.

When the control device 200 receives a detection signal that the spreader mechanism 4 is attached to the top covering shaft mechanism 2 from the sensor 201, the control device 200 sends the drive command signal to the solenoid 202, and drives the solenoid 202 to move the plunger into the movement path of the operation lever 14, whereby the operation lever 14 is restricted from moving.

Also with this configuration, whether the threading is allowed or not can be determined by attaching and detaching the spreader mechanism 2 with respect to the top covering shaft mechanism 4. Therefore, even if an operator operates the threading device 1*a* by mistake when the spreader is attached to the top covering shaft mechanism 2, collision between the threading device 1*a* and the spreader is prevented by the plunger of the solenoid 202 so that a breakage thereof can be prevented.

Further, because the threading can be restricted depending only on whether the spreader mechanism 4 is attached to the top covering shaft mechanism 2, additional operation burden is not imposed on the operator. Moreover, it is possible to warn the operator not to operate the operation lever 14 by indicating on the display 203 that the spreader mechanism 4 is attached.

Third Embodiment

Figure 10:
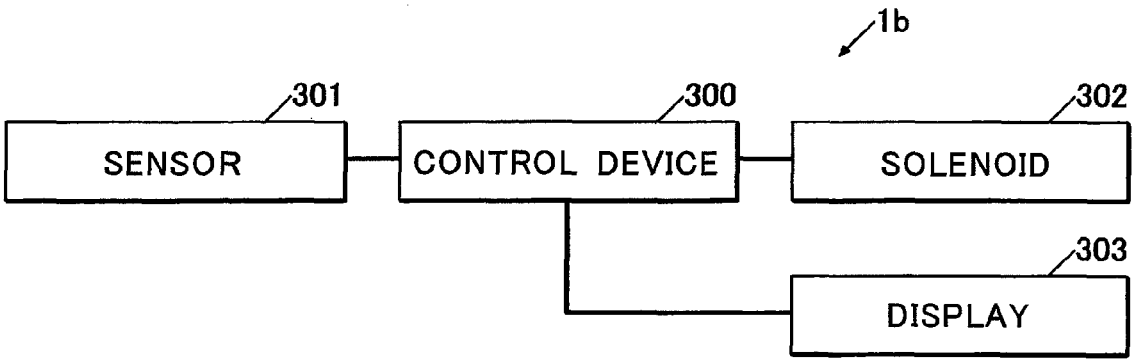
FIG. 10 is a block diagram of a configuration around a control device of a threading device of a sewing machine according to a third embodiment of the present invention.

Next, a threading device of a sewing machine according to a third embodiment of the present invention will be described. Components similar to those in the first embodiment are indicated by the same reference numerals, and description thereof will be omitted. FIG. 10 is a block diagram of the threading device 1*b* of the third embodiment.

The threading device 1*b* includes a control device 300. A sensor 301 is coupled to the control device 300, and detects that the spreader 4 is attached to the top covering shaft mechanism 2. The sensor 301 is provided on the top covering shaft mechanism 2, and when it detects that the spreader mechanism 4 is attached to the top covering shaft mechanism 2, it transmits a detection signal to the control device 300.

A solenoid 302 is coupled to the control device 300, and actuates a clutch mechanism provided between the operation lever 14 and the threading operation mechanism 13. The solenoid 302 is driven in response to a drive command signal from the control device 300 to decouple the operation lever 14 from the threading operation mechanism 13.

A display 303 is coupled to the control device 300 to notify a user that the spreader mechanism 4 is attached, and allows the user to input a command therefrom.

When the control device 300 receives a detection signal that the spreader mechanism 4 is attached to the top covering shaft mechanism 2 from the sensor 301, the control device 300 sends the drive command signal to the solenoid 302, and drives the solenoid 302 to actuate the clutch mechanism to restrict the movement of the operation lever 14 from being transmitted to the threading operation mechanism 13.

Also with this configuration, whether the threading is allowed or not can be determined by attaching and detaching the spreader mechanism 2 with respect to the top covering shaft mechanism 4. Therefore, even if an operator operates the threading device 1*b* by mistake when the spreader is attached to the top covering shaft mechanism 2, collision between the threading device 1*b* and the spreader is prevented by the operation of the clutch mechanism by the solenoid 302 so that a breakage thereof can be prevented.

Further, because the threading can be restricted depending only on whether the spreader mechanism 4 is attached to the top covering shaft mechanism 2, additional operation burden is not imposed on the operator. Moreover, it is possible to warn the operator not to operate the operation lever 14 by indicating on the display 303 that the spreader mechanism 4 is attached.

Fourth Embodiment

Figure 11:
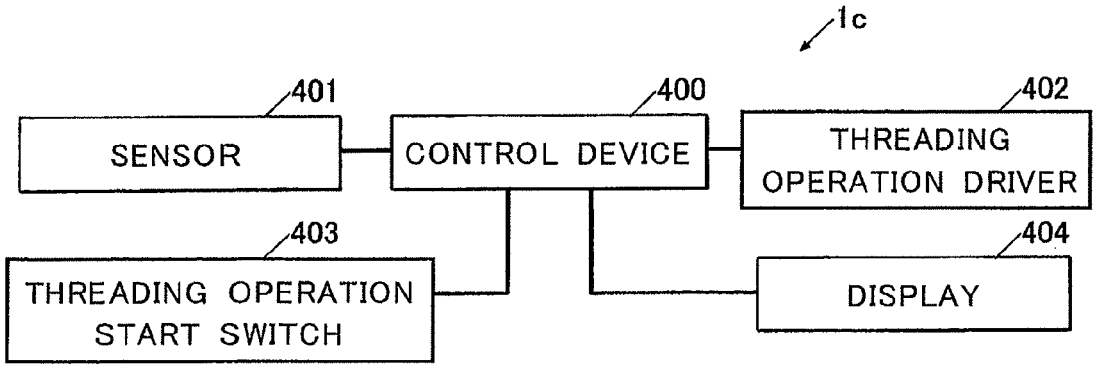
FIG. 11 is a block diagram of a configuration around a control device of a threading device of a sewing machine according to a fourth embodiment of the present invention.
Figure 12:
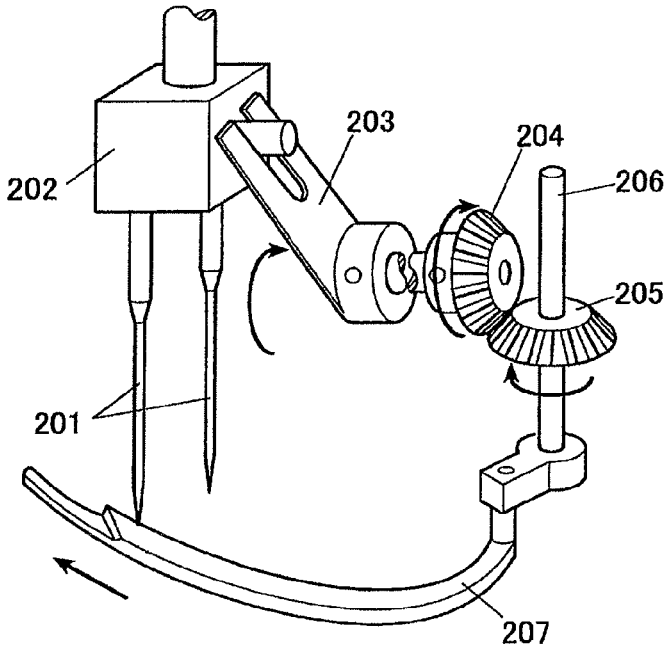
FIG. 12 is a perspective view of a spreader driving mechanism in the related art.

Next, a threading device of a sewing machine according to a fourth embodiment of the present invention will be described. Components similar to those in the first embodiment are indicated by the same reference numerals, and description thereof will be omitted. FIG. 11 is a block diagram of the threading device 1*c* of the fourth embodiment.

The threading device 1*c* includes a control device 400. A sensor 401 is coupled to the control device 400, and detects that the spreader 4 is attached to the top covering shaft mechanism 2. The sensor 401 is provided on the top covering shaft mechanism 2, and when it detects that the spreader mechanism 4 is attached to the top covering shaft mechanism 2, it transmits a detection signal to the control device 400.

A threading operation driver 402 (a drive source) is coupled to the control device 400, and drives the threading operation mechanism 13.

A threading operation start switch 403 is coupled to the control device 400, and drives the threading operation driver 402 when it is turned on. When an operator operates the threading operation start switch 403, a command is transmitted from the control device 400 to the threading operation driver 402 and a threading operation is performed.

A display 404 is coupled to the control device 400 to notify a user that the spreader mechanism 4 is attached, and allows the user to input a command therefrom.

When the control device 400 receives a detection signal that the spreader mechanism 4 is attached to the top covering shaft mechanism 2 from the sensor 401, the control device 400 invalidates a signal for driving the threading operation driver 402 which drives the threading operation mechanism 13 to restrict the threading operation mechanism 13 from being actuated.

Also with this configuration, whether the threading is allowed or not can be determined by attaching and detaching the spreader mechanism 2 with respect to the top covering shaft mechanism 4. Therefore, even if an operator operates the threading device 1*c* by mistake when the spreader is attached to the top covering shaft mechanism 2, collision between the threading device 1*c* and the spreader is prevented by invalidating the drive command signal to the threading operation driver 402 so that a breakage thereof can be prevented.

Further, because the threading can be restricted depending only on whether the spreader mechanism 4 is attached to the top covering shaft mechanism 2, additional operation burden is not imposed on the operator.

Moreover, it is possible to warn the operator not to operate the operation lever 14 by indicating on the display 403 that the spreader mechanism 4 is attached.

What is claimed is:

1. A threading device of a sewing machine, the sewing machine comprising a sewing machine main body, a needle through which a needle thread is inserted, and a spreader mechanism which interlaces a covering thread with the needle thread to form top covering stitches, wherein the spreader mechanism is attachable and detachable with respect to the sewing machine main body, the threading device comprising:

a threading hook which moves forward to enter an eye of the needle to catch the needle thread, and moves rearward with the needle thread being caught to insert the needle thread through the eye;

a threading shaft which holds the threading hook;

an operating member which is operated to move the threading shaft;

a threading operation mechanism which transmits a movement of the threading shaft to the threading hook to move the threading hook back and forth; and a restricting device which makes the threading operation mechanism inoperable when the spreader mechanism is attached to the sewing machine main body, and makes the threading operation mechanism operable when the spreader mechanism is detached from the sewing machine main body.

2. The threading device according to claim 1, wherein the restricting device comprises a lock member which is rotatably provided on the sewing machine main body, wherein the lock member comprises one end portion which is brought into contact with the spreader mechanism and rotates while attaching the spreader mechanism to the sewing machine main body, and another end portion which rotates in accordance with a rotation of the one end portion to a position on a movement path of the operating member to restrict the operating member from moving.

3. The threading device according to claim 1, wherein the restricting device comprises:

a sensor which detects that the spreader mechanism is attached to the sewing machine main body;

a plunger which moves in and out of a movement path of the operating member;

a solenoid which drives the plunger; and a control device which controls a drive of the solenoid, wherein, when the control device receives a detection signal indicating that the spreader mechanism is attached to the sewing machine main body from the sensor, the control device actuates the solenoid to project the plunger into the movement path of the operating member to restrict the operating member from moving.

4. The threading device of the sewing machine according to claim 3, wherein the sewing machine main body comprises a top covering shaft mechanism for forming covering stitches on a workpiece, wherein the spreader mechanism is attachable and detachable with respect to the top covering shaft mechanism, and the sensor detects that the spreader mechanism is attached to the top covering shaft mechanism.

5. The threading device according to claim 1, wherein the restricting device comprises:

a sensor which detects that the spreader mechanism is attached to the sewing machine main body;

a clutch mechanism disposed between the operating member and the threading operation mechanism; and a control device which controls a drive of the clutch mechanism, wherein, when the control device receives a detection signal indicating that the spreader mechanism is attached to the sewing machine main body from the sensor, the control device actuates the clutch mechanism to restricts a movement of the operating member from being transmitted to the threading operation mechanism.

6. The threading device of the sewing machine according to claim 5, wherein the sewing machine main body comprises a top covering shaft mechanism for forming covering stitches on a workpiece, wherein the spreader mechanism is attachable and detachable with respect to the top covering shaft mechanism, and the sensor detects that the spreader mechanism is attached to the top covering shaft mechanism.

7. The threading device according to claim 1, wherein the restricting device comprises:

a sensor which detects that the spreader mechanism is attached to the sewing machine main body;

a drive source which drives the threading operation mechanism; and a control device which controls a drive of the drive source, wherein, when the control device receives a detection signal indicating that the spreader mechanism is attached to the sewing machine main body from the sensor, the control device invalidates a signal, which causes the drive source to drive the threading operation mechanism, to restrict the threading mechanism from being operated.

8. The threading device of the sewing machine according to claim 7, wherein the sewing machine main body comprises a top covering shaft mechanism for forming covering stitches on a workpiece, wherein the spreader mechanism is attachable and detachable with respect to the top covering shaft mechanism, and the sensor detects that the spreader mechanism is attached to the top covering shaft mechanism.

* * * * *